US006138365A

United States Patent [19]

Wilkins

[11] Patent Number: 6,138,365

[45] **Date of Patent: *Oct. 31, 2000**

[54] HOBBYIST PANTOGRAPH AND METHOD OF USING THE SAME

[76] Inventor: Raymond Jeff Wilkins, 5147 E. Adobe Rd., Mesa, Ariz. 85205

[ * ] Notice: This patent is subject to a terminal disclaimer.

[21] Appl. No.: 09/153,966

[22] Filed: Sep. 16, 1998

[51] Int. Cl.[7] ..... B43L 13/10

[52] U.S. Cl. ..... 33/25.2; 33/23.01

[58] Field of Search ..... 33/23.01, 23.08, 33/23.11, 25.1, 25.2, 25.3, 25.4, 25.5

[56] References Cited

U.S. PATENT DOCUMENTS

| | | | |
|---|---|---|---|
| 1,692,103 | 11/1928 | Williams | 33/25.2 |
| 1,734,573 | 11/1929 | Gray | 33/25.4 |
| 2,674,042 | 4/1954 | Ott . | |
| 2,782,505 | 2/1957 | Guischard | 33/25.1 |
| 2,881,521 | 4/1959 | Pearson, Jr. . | |
| 3,496,795 | 2/1970 | Dinnendahl . | |
| 3,570,129 | 3/1971 | Del Vecchio | 33/25.2 |
| 3,956,828 | 5/1976 | Kloweit | 33/23.11 |
| 4,448,120 | 5/1984 | Richardson et al. | 33/23.01 |

FOREIGN PATENT DOCUMENTS

| | | | |
|---|---|---|---|
| 21673 | 10/1900 | United Kingdom | 33/25.2 |

OTHER PUBLICATIONS

The Green Engraver, promotional filer, Apr. 1951.

*Primary Examiner*—G. Bradley Bennett
*Attorney, Agent, or Firm*—Weiss & Moy, P.C.; Jeffrey Weiss; Jeffrey D. Moy

[57] ABSTRACT

A hobbyist pantograph is provided that includes a base, and an arm assembly substantially in the shape of a parallelogram that rotates about a vertical and horizontal axis of rotation such that movement of a stylus around a template causes proportionate and precise movement of a tool on a workpiece. A main beam of the arm assembly remains substantially horizontal. The stylus and the tool are received in free ends of the arm assembly. The stylus is spring-loaded and adapted to receive a variety of inserts. The free end of the arm assembly that receives the tool includes a tool holder adapter clamp into which an adapter may be fitted to accept a wide variety of tools which the hobbyist may already own. The tool may be motorized or manual. A method of using the pantograph is also provided.

15 Claims, 6 Drawing Sheets

HOBBYIST PANTOGRAPH AND METHOD OF USING THE SAME

FIELD OF THE INVENTION

This invention relates generally to craft and hobby tools and, more specifically, to a hobbyist pantograph and method of using the same.

BACKGROUND OF THE INVENTION

A pantograph is an instrument for the copying of alphanumerics, pictures, and graphic representations at a desired scale. With a pantograph, a point is constrained to copy the path traced by another point based on the geometry of a parallelogram. A traditional pantograph includes bars pivotally linked together to form the parallelogram with pivotal corners, a stylus at one of the corners for tracing the outline of the object to be copied (a template) and a tool for making a scaled copy of the object on a workpiece. The tool normally is in one of the bars of the parallelogram and the stylus is in a separate bar constrained t o stay parallel to the bar with the tool. The traditional pantograph operates with a horizontal axis of rotation for lifting the tool from the workpiece. Typically, the horizontal axis of rotation through a yoke assembly is separate from the bars that make up the parallelogram and opposite a main pivot point. A main bar pivots up and away from the base by the yoke assembly.

Some hobby and craft applications require precision copying and control as well as consistency and traditional hand-held tools have not sufficed. Furthermore, while traditional pantographs have been available for such use, these have been relatively expensive and limited in application. For example, some pantographs are designed for engraving from character sets only. For increasing precision and versatility, computerized controlled pantographs have been developed but these are not practically available to the hobbyist due to their cost, complexity, etc.

There is therefore a need for a pantograph that permits substantially precise copying and control for consistency and reproducibility. There is further a need for a pantograph that will accept various tools, some of which may already be on hand by the hobbyist. There is further a need for a pantograph that can copy from a wide range of templates, not just character sets. Additionally, there is a need for a pantograph of simple construction such that its cost is not prohibitive to the hobbyist. There is a further need for a pantograph for the engraving or other marking of characters, designs, figures or other artwork into almost any medium. There is a still further need for a pantograph that is versatile with a variety of applications. An additional need exists for a pantograph that is relatively compact and hardy. The present invention fulfills these needs and provides other related advantages.

SUMMARY OF THE INVENTION

The present invention resides in an improved pantograph device and method used to duplicate shapes from a template onto a workpiece. The pantograph device comprises, generally, a base, an arm assembly connected thereto and rotatable in two axes for cooperative movement of a stylus and a tool received therein.

In a preferred form of the invention, the arm assembly includes a main beam and a substantially parallel associate beam, and a stylus beam and a substantially parallel tool holder beam. The main beam and the associate beam are each pivotally linked to the stylus beam and to the tool holder beam. The beams are pivotally linked by pivot pins to form substantially a parallelogram. The chosen placement of the pivot pins in a selection of bushed openings at the pivot points between the tool holder beam and the main beam and between the tool holder beam and the associate beam permits changing the ratio of movement between the stylus and the tool.

The main beam is connected to the main boss by a main beam pin. The main boss provides rotation of the arm assembly in two axes through a main boss pin and the main beam pin. The main boss pin forms a vertical axis of rotation permitting rotation of the arm assembly in an arc about the main boss. In addition, the main beam rotates about a horizontal axis of rotation in relationship to the main boss pin to allow lifting of the stylus and the tool, i.e. there is an axis of rotation perpendicular to the axis of rotation of the main boss pin and approximately perpendicular to the stylus beam. The main beam remains substantially horizontal even with rotation.

The stylus beam terminates at a free end in a split nut for receiving the stylus. The stylus includes a body that is substantially cylindrical. A precision bore defines the internal diameter of the stylus body. A spring-loaded plunger is received and retained in the bore. The plunger moves vertically against the spring and the travel of the plunger is adjusted by turning a travel limit adjustment screw at the top of the stylus. A thumbnut locks the position of the adjustment screw. A lower end of the plunger also includes a precision bore to receive a collet retained by a collet nut attached to the lower end of the plunger. The collet receives an insert having a lower end that contacts the template or gauge. A variety of inserts may be used depending upon the template. The inserts differ in their lower end.

The tool holder beam terminates at a free end thereof in a tool holder adapter clamp to receive an adapter for holding a tool. The tool holder adapter clamp has a central opening for receiving the adapter. The outside diameter of the adapter fits the tool holder adapter clamp while the inside diameter of the adapter fits the tool and thus may change depending upon the tool being used.

The tool received in the adapter may be manual or motorized. An auxiliary boss next to the main boss supports an upstanding shaft in which a flex shaft motor may be suspended from a hook. The flex shaft motor includes a motor turning a flexible shaft attached to a hand piece or tool. A foot switch or pedal may be used.

The main boss and main boss pin connect the arm assembly to the rigid underlying base. The base includes a substantially flat upper surface to which the arm assembly is mounted near one edge. The upper surface extends on two other edges to form a clamping ledge.

The workpiece is held under the tool by a first pair of clamping rails and the template is held under the stylus by a second pair of clamping rails. The ends of each of the clamping rails are secured under the clamping ledge by a clamp and associated screw. A pressure sensitive dial indicator may be used to substantially confirm that the workpiece is substantially flat before beginning to copy a shape thereon from the template. The dial indicator may be modified to include a substantially cylindrical adapter to permit receipt in the tool holder adapter clamp.

At least one clamp assembly overlies the corners of and mounts the workpiece and the template to the base between the respective clamping rails of each pair. The clamping rails may include a T-slot, which may be extruded therein to receive the substantially square head of at least one clamping bolt therein at any position along the length of the rail. The clamp assembly includes a clamping plate having a first and second opening therein. An upstanding threaded portion of the clamping bolt extends upwardly through the first opening in the clamp assembly. A nut is then tightened around the threaded portion. The second opening in the clamping plate is threaded for receipt of a downwardly extending screw that provides a fulcrum for the clamping force. The clamping rails may include mounting ports along their length rather than a T-slot, in which case fastening means other than the clamping bolts may be used whenever mounting between the clamping rails is required. For example, the mounting ports may receive the downwardly extending threaded portion of screws.

A vise may be used to hold odd-shaped workpieces. The vise includes a substantially rectangular fixed jaw and a moveable jaw assembly. The moveable jaw assembly includes a substantially rectangular moveable piece and a substantially rectangular fixed piece held in substantially parallel relationship by a pair of cylindrical ways. The moveable and fixed pieces of the moveable jaw assembly may be brought together or separated by means of a screw or the like. The ends of each of the fixed jaw and moveable jaw assembly are adapted to seat between the first pair of clamping rails. The ends of the fixed jaw and fixed piece include openings therein which receive the upstanding clamping bolts at any desired position along the length of the clamping rails. The workpiece is placed on a ledge defined by an inner surface of each of the fixed jaw and the moveable piece.

A ball pin may extend upwardly from an upper surface of the moveable piece. The ball pin may be engaged by the collet in the stylus. This arrangement is typically used with a shaper attachment. With this arrangement, the vise is mounted in the template area between the second pair of clamping rails for precision control of the stylus and the tool.

The shaper attachment includes a substantially rectangular plate that is mounted between the first pair of clamping rails by at least one clamp assembly and associated clamping bolts. An upper surface of the plate may include a longitudinal groove and a reference notch. A variety of accessories may be used on the upper surface to create various edges on the workpiece. Such accessories include, for example, fixed and moveable gage plates, a parallel gage plate, or an adjustable angle accessory.

The method of the invention includes the steps of selecting a ratio between the tool holder and stylus beams and inserting and securing pivot pins accordingly, selecting and mounting an insert, a template, a tool and a workpiece, and driving the stylus around a shape on the template for copying, at a selected scale, the shape on the workpiece by the cutting or other marking tool.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 1B, 2A, 2B, 5A:
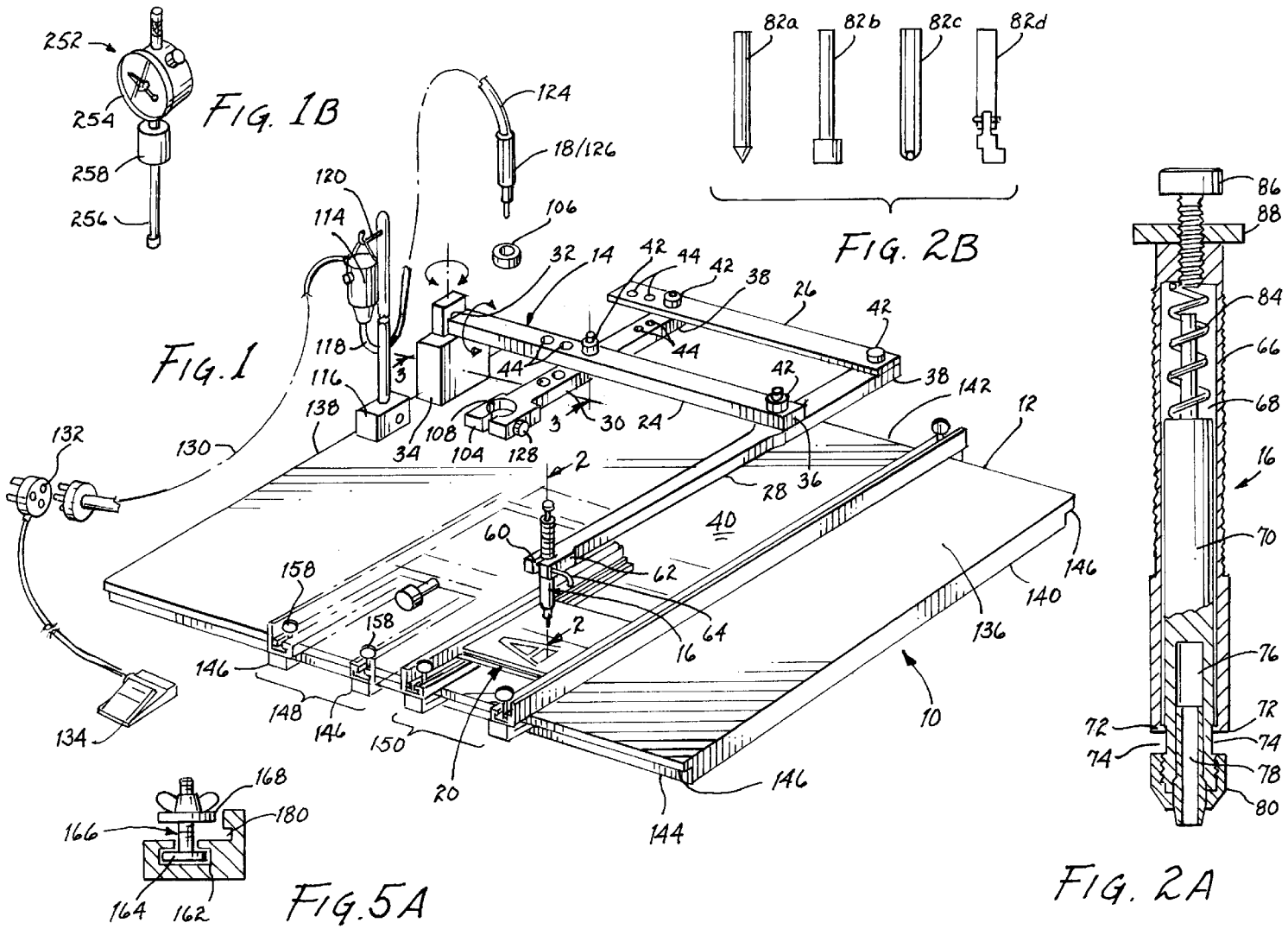
FIG. 1 is a perspective view of a hobbyist pantograph embodying the invention, illustrating an arm assembly substantially in the shape of a parallelogram mounted to an upper surface of a base though a main boss, the arm assembly including a main beam pivotally linked to the main boss by a main boss pin and the main beam and a substantially parallel associate beam pivotally linked to a tool holder beam and stylus beam, the base divided by a first pair of clamping rails between which is a vise adapted to receive a workpiece therein for placement under a tool received in the tool holder beam and a second pair of clamping rails between which is an exemplary character set under the stylus to serve as a template, the tool connected by a flexible shaft to a motor.
FIG. 1B is a perspective view of a dial indicator, illustrating the provision of an adapter for fitting into a tool holder adapter clamp of the tool beam.
FIG. 2A is an enlarged sectional view taken generally along the line 2—2 of FIG. 1, illustrating the stylus having a substantially cylindrical body with a precision bore extending vertically therethrough for receiving a spring-loaded plunger, the plunger retained in the precision bore by a clip and a step and including a bore at a lower end for receiving a collet that receives an insert selected depending on the template used, plunger movement being controlled by a travel limit adjustment screw and thumbnut.
FIG. 2B is a perspective view of four exemplary inserts that may be received in the collet.
FIG. 5A is a sectional view of one of the clamping rails taken generally along the line 5A—5A of FIG. 5, illustrating the provision of a T-slot and a notch therein, the T-slot receiving a substantially square head of the clamping bolt with the upstanding threaded portion extending through the clamping plate of the clamp assembly and secured by the wingnut, the notch illustrated as empty but adapted to receive a tab at the upper and lower edges of the character set tile.

As shown in the drawings for purposes of illustration, the present invention is concerned with an improved pantograph device, generally designated in the accompanying drawings by the reference number 10. The pantograph device 10 comprises, generally, a base 12, an arm assembly 14 connected thereto and rotatable in two axes for cooperative movement of a stylus 16 and a tool 18 received therein.

In accordance with the present invention, and as illustrated with respect to a preferred embodiment in FIGS. 1–11, the pantograph device 10 can be used to duplicate shapes at a reduced scale from a template 20 onto various workpieces (not shown), in a number of ways, for example, by engraving, grinding, carving, or otherwise marking.

As shown in FIG. 1, the arm assembly 14 that forms substantially a parallelogram includes a main beam 24 and a substantially parallel associate beam 26, and a stylus beam 28 and a substantially parallel tool holder beam 30. The main beam 24 extends at a first end 32 from a main boss 34 over the tool holder beam 30 to a second end 36 terminating over the stylus beam 28. The main beam 24 is pivotally linked to each of the tool holder beam 30 and the stylus beam 28. The stylus beam 28 and the tool holder beam 30 are also each pivotally linked at a first end thereof 38 to opposite ends of the associate beam 26. The associate beam 26 overlies the tool holder and stylus beams 30 and 28. The associate beam 26 is opposite and outside a work area 40 of the pantograph 10 permitting a larger workspace. This is possible by having the horizontal axis of rotation through the centerline of the main beam.

Figure 3:
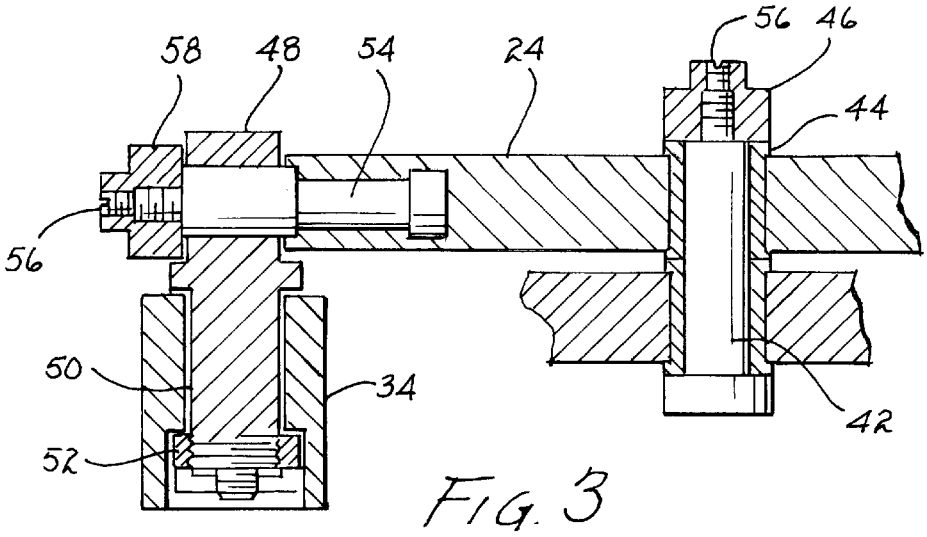
FIG. 3 is a sectional view taken generally along the line 3—3 of FIG. 1, illustrating the main beam pivotally linked to the main boss and to the tool holder beam by a pivot pin received in a precision bushed opening.

The beams 24, 26, 28, and 30 are pivotally linked by a pivot pin 42 received in a precision bushed opening 44 in each of the beams that mates with a corresponding precision bushed opening 44 in the linked beam. The pivot pin 42 is secured in the bushed opening 44 by a nut 46 as shown in FIG. 3. The pivot pins 42 may be locked after adjustment by a setscrew 56. As shown in FIG. 1, the tool holder beam 30 includes three of the precision bushed openings 44 about the middle and three about the end thereof. One of the three openings in the middle and one of the three openings at the end are selected for placement of the pivot pin 42 respectively linking the main beam 24 and associate beam 26 thereto. The main beam 24 and associate beam 26 each include three corresponding openings 44, one of which in each of the main beam 24 and associate beam 26 is selected to mate with the selected openings 44 in the tool holder beam 30. The chosen placement of the pivot pin 42 permits changing the ratio of movement between the stylus and the tool. It is to be appreciated that parallelogram size may change slightly with placement of the pivot pins 42. It is also to be appreciated that there may be more or less than three openings 44 from which to choose in order to change the ratio. The bushings 44 may be molded in place with a precision location and with a precision diameter.

As shown in FIG. 3, the main beam 24 is connected to the main boss 34 by a main boss pin 48. The main boss 34 includes a precision bore 50 extending vertically therein. The main boss pin 48 slip fits into the bore 50 and is retained by a collar 52 or retainer nut in the main boss 34. A main beam pin 54 extends horizontally through the main boss pin 48. The setscrew 56 extending into a main beam nut 58 may be turned to lock the adjustment of the main beam pin 54.

Figure 12:
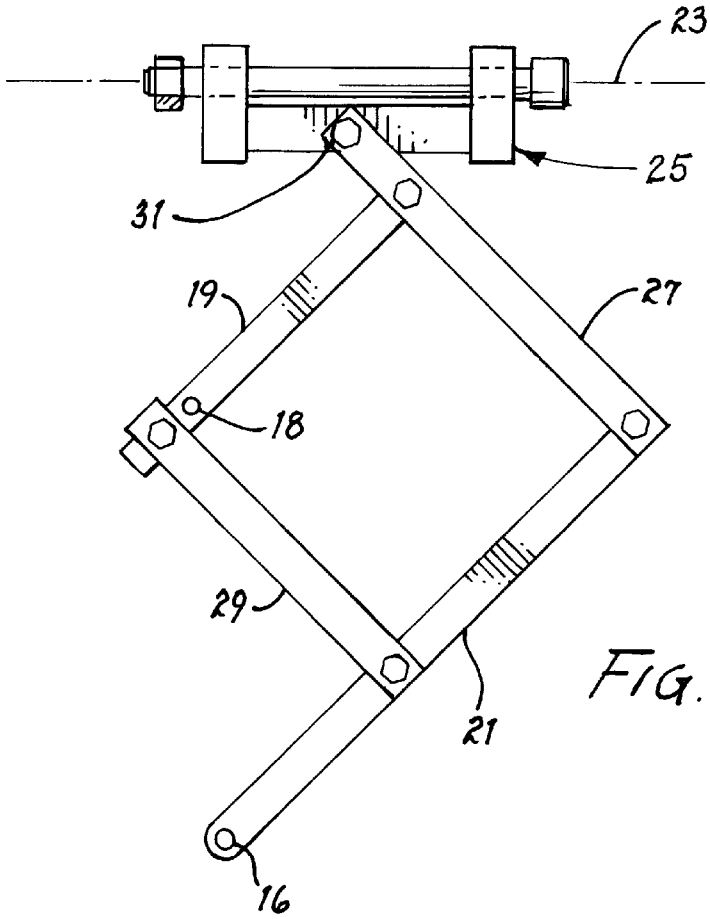
FIG. 12 (PRIOR ART)
FIG. 12 is a top view of a traditional pantograph, illustrating a stylus bar parallel to a tool bar having a tool therein, the ends of each of the stylus and tool bars connected to a main bar and a parallel associate bar to form a parallelogram, the horizontal axis of rotation through a separate yoke assembly.

The main boss 34 provides rotation of the arm assembly 14 in two axes through the main boss pin 48 and the main beam 24. The main boss pin 48 forms a vertical axis of rotation permitting rotation of the arm assembly 14 in an arc about the main boss 34. In addition, the main beam 24 rotates about a horizontal axis of rotation in relationship to the main boss pin 48 to allow lifting of the stylus 16 and the tool 18, i.e. there is an axis of rotation perpendicular to the axis of rotation of the main boss pin 48 and approximately perpendicular to the stylus beam 28. The main beam 24 remains substantially horizontal. It is this arrangement that allows the associate beam to be outside the work area and still keep the leverage advantage required to lift the tool permitting precise and rigid control of copying. This arrangement differs from the traditional pantograph shown in FIG. 12. In the traditional pantograph, the tool 18 normally is in one of the bars of the parallelogram, a tool bar 19, and the stylus 16 is at the end of a stylus bar 21 constrained to stay parallel to the tool bar 19. The traditional pantograph operates with a horizontal axis of rotation 23 for lifting the tool 18 from the workpiece. Typically, the horizontal axis of rotation 23 through a yoke assembly 25 is separate from the bars that make up the parallelogram and opposite a pivot point. A main bar 27 does not remain substantially horizontal. The main bar 27 is parallel to an associate bar 29 and pivotally coupled to the yoke assembly 25 for a vertical axis of rotation 31.

The stylus beam 28 terminates at a second end thereof 60 in a split nut 62 for receiving the stylus 16. The split nut 62 permits fine adjustment and precision control of stylus position. The split nut 62 may be tightened or loosened by a levered or bent screw 64 as shown in FIG. 1. The split nut 62 includes internal threads (not shown) therein, the purpose for which will be hereinafter described.

As shown in FIG. 2A, the stylus 16 includes a body 66 that is substantially cylindrical. The external surface of the stylus body 66 may be threaded at an upper end for engagement with the internal threads (not shown) of the split nut 62 for positioning of the stylus 16 in the stylus beam 28 and knurled at a lower end to permit better gripping action with the fingers as the stylus 16 is held like a pencil. A precision bore 68 defines the internal diameter of the stylus body 66. A plunger 70 is received in the bore 68. A substantially circular clip 72 and a step 74 machined into the external surface of the stylus body 66 in combination retain the plunger 70 in the stylus body 66 by decreasing the bore diameter. A lower end of the plunger also includes a precision bore 76 to receive a collet 78 that is retained by a collet nut 80 attached to the lower end of the plunger 70. The collet 78 is open-ended to receive an insert 82.

The plunger 70 is pushed down by an internal spring 84 in the upper end of the stylus bore 68. The travel of the plunger 70 is controlled by turning a travel limit adjustment screw 86 at the top of the stylus 16. A thumbnut 88 locks the position of the adjustment screw 86. Both the adjustment screw 86 and the thumbnut 88 may be knurled for better gripping action. The adjustment screw 86 limits the up and down motion of the plunger 70. Although the stylus body 66 is locked into the split nut 62, the plunger 70, collet 78 and collet nut 80 are free to move vertically against the spring resistance until the upper end of the plunger 70 contacts the bottom of the adjustment screw 86. This allows the hobbyist to have the stylus insert in a template groove without engaging the tool on a workpiece until the spring is compressed. When the bottom of the adjustment screw 86 contacts the upper end of the plunger 70, the spring is not compressed. This is particularly advantageous when the hobbyist does not want to apply pressure, for example, when using the insert with a roller mechanism 82(*b*) for tracing on a paper or other fragile layout template.

An upper portion of the insert 82 may be inserted into a lower end of the collet 78. The collet 78 grips the insert 82 and provides a quick release mechanism therefor. The upper portion of the insert 82 is substantially cylindrically shaped. A lower end of the chosen insert contacts a template or gauge. A variety of different insets may be provided with the pantograph, each insert differing from the other in the lower end. Exemplary inserts are shown in FIG. 2B. Their lower ends may be ground to a point for following a groove in the template 82(*a*), may include the roller mechanism for tracing sketches or pictures 82(*b*), may include a cylinder available in different sizes for edge tracing off center 82(*c*), or may include a swivel device for tracing around edges on center i.e. it pivots around the center line 82(*d*). Selection of the particular insert 82 depends upon the template 20 used.

The template 20 may include alphanumeric character sets 90(FIG. 4), pictures or graphical representations including, but not limited to, plans, drawings, stencils, diagrams, charts, maps, patterns. The template 20 may be prepared, for example, from layouts or tracings, which may or not be up or down scaled. The layout or tracing may itself be the template 20. If the layout or tracing is on paper, the paper may be taped under the stylus 16 as hereinafter described and the roller ball insert 82(*b*) used. If a substantial number of workpieces (not shown) are desired, one may engrave plastic engraving stock (the workpiece) using the layout or tracing itself as the template 20 and then subsequently using the engraved plastic engraving stock as the template 20.

Figure 4:
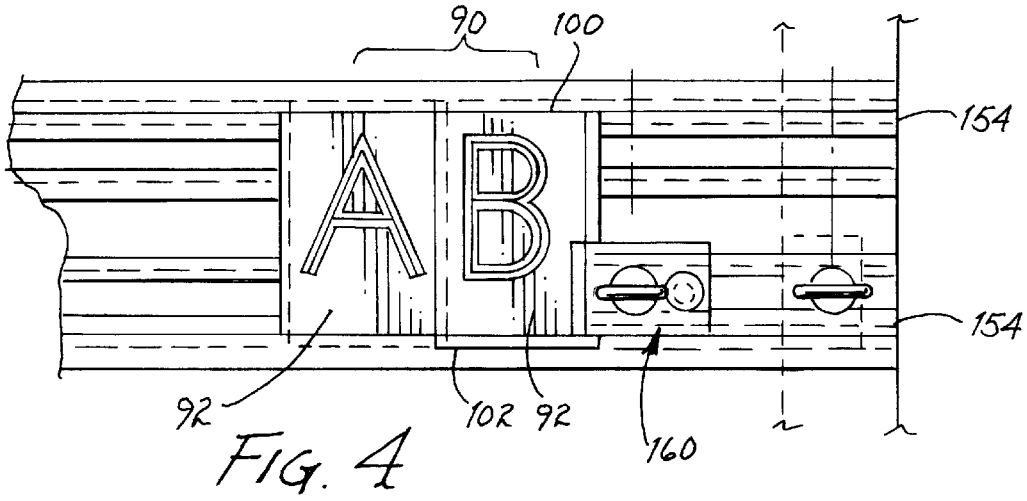
FIG. 4 is a top view of the exemplary character set secured between the second pair of clamping rails, illustrating a clamping plate of a clamp assembly overlying a corner of a character set tile, the clamping plate including two openings therein for respectively receiving an upstanding threaded portion of a clamping bolt secured by a wingnut and a screw.
Figure 5:
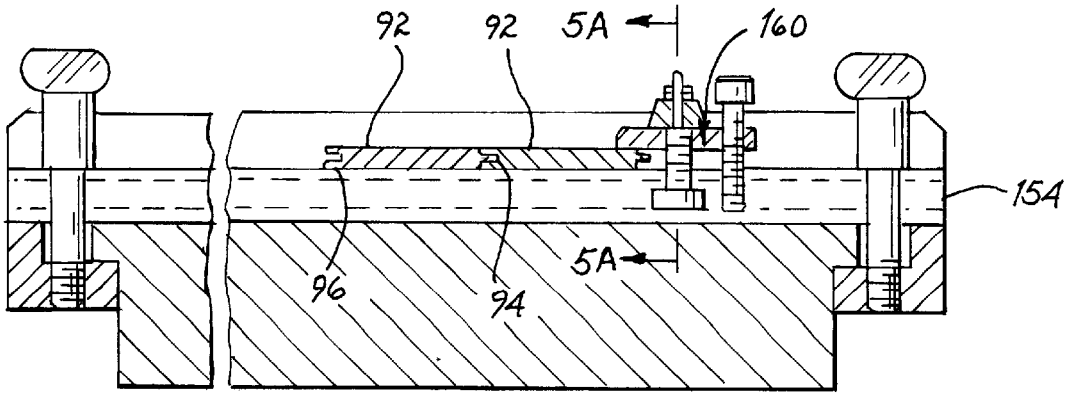
FIG. 5 is a enlarged sectional view of the clamp assembly of FIG. 4 with one of the clamping rails extended, illustrating the ends of the clamping rail secured over a clamping ledge on opposite edges of the base by a clamp and associated screw, the clamp assembly securing the tiles of the character set that include a tongue on a side edge and a corresponding groove on an opposite side edge for interlocking with adjacent tiles.

If using character sets 90 such as shown in FIGS. 4 and 5, the alphanumeric characters are each engraved on tiles 92. Each of the tiles 92 include a tongue 94 on a side edge and a corresponding groove 96 on an opposite side edge, the purpose for which is to interlock with adjacent tiles 92 when mounted under the stylus 16. The tiles 92 also include a tab (not shown) on an upper 100 and a lower edge 102, the purpose for which will be hereinafter described.

As shown in FIG. 1, the tool holder beam 30 which is shorter than the stylus beam 28 terminates at a free end thereof in a tool holder adapter clamp 104 to receive an adapter 106 for holding the tool 18. The tool holder adapter clamp 104 has a central opening 108 for receiving the adapter 106 or split bushing therein. The adapter 106 may be a universal adapter, and is preferably made from molded plastic. As shown in FIGS. 7A–7F, the universal adapter 106 includes setscrews 110 substantially diametrically opposite each other at an upper and a lower end of the adapter 106. The outside diameter of the adapter 106 fits the tool holder adapter clamp 104 while the inside diameter of the adapter 106 fits the tool 18. The setscrews 110 are tightened when the tool 18 is removed from the tool holder adapter clamp 104. Exemplary universal adapters include those with inside diameters of about 0.75 inches to about 1.00 inches, about 0.50 inches to about 0.75 inches and about 0.12 inches to about 0.50 inches. With respect to the adapter 106 with an inside diameter of about 0.75 inches to about 1.00 inches, a substantially ring-shaped collar 112 with the setscrews 110 slip fits over the adapter 106 after it is inserted into the tool holder adapter clamp 104.

The tool 18 received in the adapter 106 may be manual or motorized. A flex shaft motor 114 as shown in FIG. 1 manufactured, for example, by Dremel and Ryobi would be particularly useful for attachment to and for driving the tool 18 and such a motor 114 is typically already on hand by the hobbyist. An auxiliary boss 116 next to the main boss 34 supports an upstanding shaft 118 in which the flex shaft motor 114 is suspended from a hook 120. The flex shaft motor 114 includes the motor 114 turning a flexible shaft 124 attached to the tool 18 or hand piece 126. The hand piece 126 holds various cutting, grinding, and polishing tools 18. Hand-held motors, vibrating engravers or static tools 18 may also be adapted to the pantograph 10. The tool 18 or hand piece 126 fits downwardly into the adapter 106 or tool holder adapter clamp 104 and is tightened therein. Tightening of the tool holder adapter clamp can be done by a screw 128 or other conventional means. Course adjustment may be made by loosening the tool holder adapter clamp 104 and moving the tool 18 or hand piece up 126 and down. An electrical lead 130 from the flex shaft motor 122 may be plugged into an outlet 132 for a foot switch or pedal 134, which is in turn connected to an outlet (not shown).

The universal adapter 106 permits the use of any type of hand held tool 18. Exemplary tools include engraving, cutting, grinding, buffing, drilling, carving, sanding drums and other marking tools. The cutting tools may include, for example, ball cutters, square cutters, angle cutters, and bevel cutters as described hereinafter. Single or multiple flute tools may be used.

Movement of the stylus 16 on the template 20 or gauge (the "input") causes a proportionate yet precise movement of the tool 18 on the workpiece (the "output") to create a reduced size copy on the workpiece of the shape on the template 20. The size ratio of output to input can be adjusted by selecting from one of the mated openings 44 for receipt of the pivot pins 42. The bushed openings 44 allow a choice of at least three ratios of the pantograph. The preferred ratios are 2:1, 3:1, and 4:1 but other reduction ratios may, of course, be used. The size of the work area 40 varies depending on the ratio selected. The size of the pantograph 10 may be changed with commensurate increases in work area 40.

The main boss 34 and main boss pin 48 connect the arm assembly 14 to a substantially flat upper surface 136 of the rigid underlying base 12. The base 12 is substantially rectangular-shaped and used in a substantially horizontal position. The base 12 includes a lower surface (not shown) adapted to sit on a tabletop. The arm assembly 14 is attached near a first edge 138 of the base 12. A fourth edge 140 is opposite the first edge. The base 12 includes a second edge 142 and an opposite third edge 144, which are perpendicular to the first and fourth edges 138 and 140. The upper surface 136 extends slightly beyond the second and third edges 142 and 144 of the base 12 to form a clamping ledge 146, the purpose for which will be hereinafter described.

The upper surface or work area 40 is divided into a workpiece portion 148 and a template portion 150 by a first and a second pair of interchangeable clamping rails 152 and 154. The clamping rails 152 and 154 extend from the second edge 142 to the opposite third edge of the base 144. The rails 152 and 154 may be infinitely moved between the first and fourth edges 138 and 140. Once their desired location is reached, the ends of each of the clamping rails 152 and 154 are secured under the clamping ledge 146 by a clamp 156 and associated screw 158 received therein. As shown in FIG. 5, the ends of the rails may be chamfered for added safety to substantially prevent abrasions.

The workpiece (not shown) is held under the tool 18 by the first pair of clamping rails 152 and the template 20 is held under the stylus 16 by the second pair of clamping rails 154. At least one clamp assembly 160 overlies the corners of the workpiece and the template 20 (FIGS. 9 and 10) to mount the workpiece and the template between the respective clamping rails of each pair. As shown in FIG. 5A, preferably each of the clamping rails 152 and 154 may include a T-slot 162, which may be extruded therein to receive the substantially square head 164 of a clamping bolt 166 therein at any position along the length of any of the clamping rails. The clamp assembly 160 includes a clamping plate 168 having a first and second opening therein 170 and 172. An upstanding threaded portion 174 of the clamping bolt 166 extends upwardly through the first opening 170 in the clamp assembly 160. A nut 176 is then tightened around the threaded portion 174. A wingnut may be used as shown in FIG. 4. The second opening 172 in the clamping plate 168 is threaded for receipt of a downwardly extending screw 178. This screw 178 provides the pivot point for the clamp assembly 160 and allows the hobbyist to firmly secure the workpiece (not shown) and template 20 in the respective clamping rails 152 and 154 while being worked on. Any standard shaped template or workpiece may be similarly mounted. If the rails do not include a T-slot, fastening means other than the clamping bolts may be used in the clamp assembly and mounting ports (not shown) along the length of the clamping rails receive the fastening means.

FIG. 4 shows an exemplary template 20 of the alphanumeric character set 90 between each clamping rail of the second pair of clamping rails 154. The tabs (not shown) at the upper and lower edges 100 and 102 of each of the tiles 92 are inserted into a notch 180 (FIG. 5A) defined in an interior edge of the clamping rails. The opposite rail is brought into position against the lower edge 102 to retain the character set 90 and the clamp assembly 160 secured over at least one corner of the tile 92.

The workpiece (not shown) may be essentially any media surface, for example, glass, stone, wood, metal, plastic, mother of pearl, bronze, brass, etc. The workpieces may be tags, plates (e.g. nameplates), jewelry, plaques, trays, badges, machine parts, etc. made from such materials as plastic, wood, metals, wood, etc. The workpieces may be fiat or oddly shaped.

Figure 6:
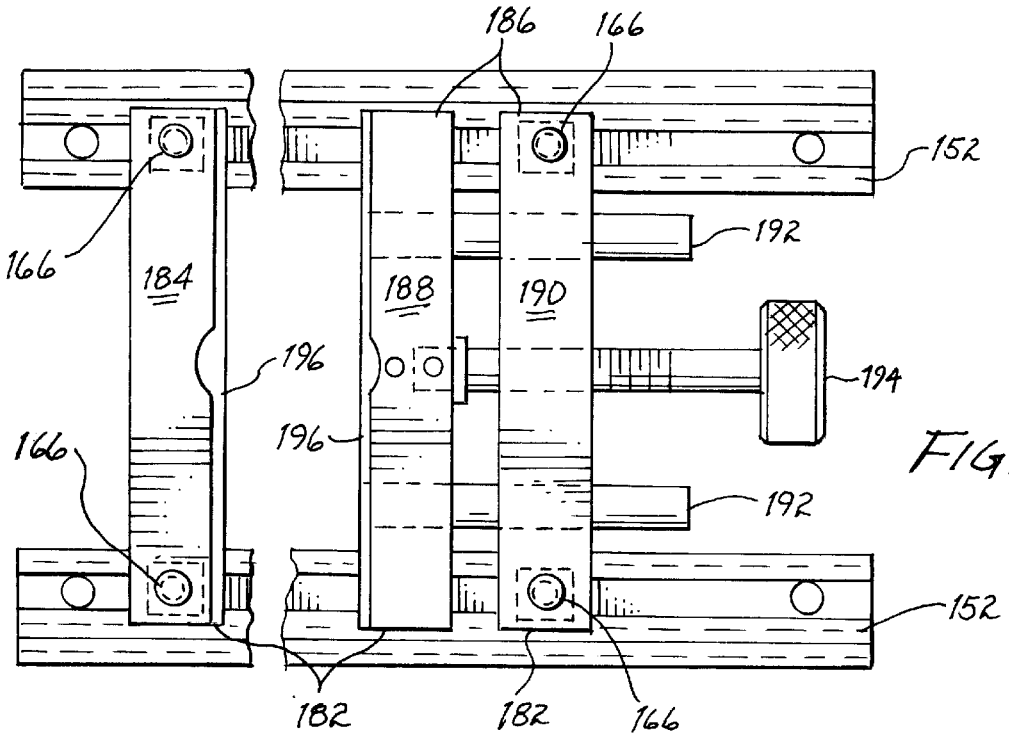
FIG. 6 is a top view of the vise mounted between the first pair of clamping rails, illustrating the provision of a fixed jaw in substantially parallel relationship with a moveable jaw assembly, the moveable jaw assembly including a moveable and fixed piece held in substantially parallel relationship by a pair of cylindrical ways, the moveable piece moved toward or away from the fixed jaw by a screw to adjust for the size of the workpiece held on a ledge defined by an inside edge of each of the fixed jaw and the moveable piece, the vise mounted by clamping bolts received in openings at the ends of each of the fixed jaw and the fixed piece of the moveable jaw assembly.
Figure 7B:
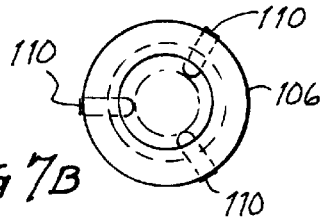
FIG. 7B is a top view of the adapter of FIG. 7A.
Figure 7D:
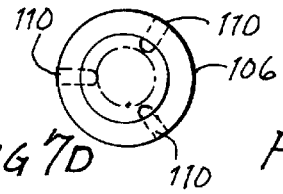
FIG. 7D is a top view of the adapter of FIG. 7C.
Figure 7F:
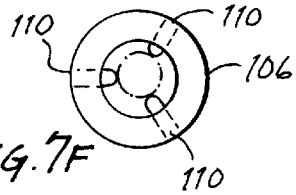
FIG. 7F is a top view of the adapter of FIG. 7E.
Figure 7A:
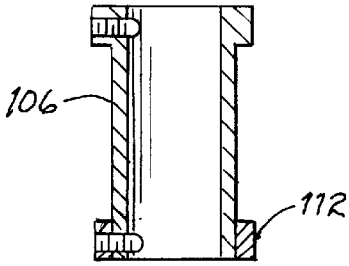
FIG. 7A is a sectional view of an adapter for a tool holder adapter clamp.
Figure 7C:
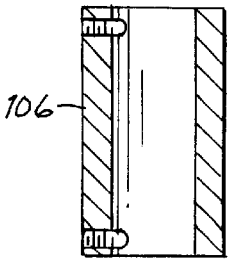
FIG. 7C is a sectional view of another size adapter for the tool holder adapter clamp.
Figure 7E:
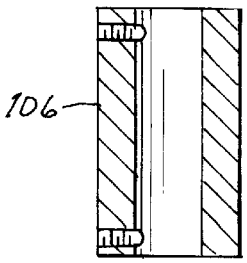
FIG. 7E is a sectional view of another size adapter.

The pantograph 10 may also include a vise 182 to hold odd-shaped workpieces 22 while work is being done on them. The clamp assembly 160 need not be used to hold the workpiece (not shown) when using the vise. Putty or clay may also be used to aid in supporting the workpiece. When assembled as shown in FIG. 6, the vise 182 includes a substantially rectangular fixed jaw 184 and a moveable jaw assembly 186. The moveable jaw assembly 186 includes an inside substantially rectangular moveable and an outside fixed piece 188 and 190 held in substantially parallel relationship by a pair of cylindrical ways 192. The moveable and fixed pieces 188 and 190 of the moveable jaw assembly 186 may be brought together or separated by means of a screw 194 or the like. The ends of each of the fixed jaw 184 and moveable jaw assembly 186 are adapted to be secured between the first pair of clamping rails 152 by the upstanding clamping bolts 166 received in openings in the vise. The vise 182 may be secured at any position along the length of the first pair of clamping rails because of the moveability of the clamping bolts 166 in the T-slot 162. The workpiece may be placed on a ledge 196 defined by an inner surface of each of the fixed jaw 184 and the moveable piece 188.

Figure 7:
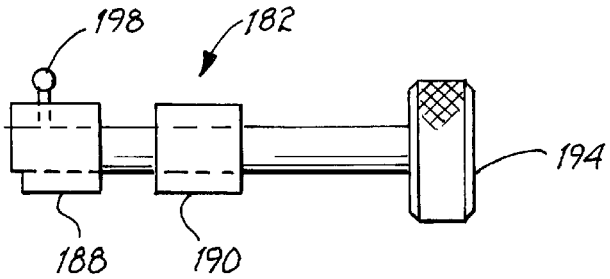
FIG. 7 is a side view of the vise shown in FIG. 6, illustrating a ball pin extending upwardly from the upper surface of the moveable piece.

A ball pin 198 may extend upwardly from an upper surface of the moveable piece 188 as shown in FIG. 7. The ball pin 198 may be engaged by the collet 78 in the stylus 16. This arrangement is typically used with a shaper attachment 200 and permits precision control of the stylus 16 in one axis, precisely advancing the tool 18.

The shaper attachment 200 in combination with various accessories may be used on the workpiece for truing or creating a straight edge thereon, creating parallel edges, creating square edges or creating angles, and edge shaping such as chamfering (beveling) edges.

The basic shaper attachment 200 includes a substantially rectangular plate 202 that is mounted between the first pair of clamping rails 152 in the workpiece portion 148 of the work area 40. The plate 202 includes a first and a second edge 204 and 206 that are secured along the clamping rails and a third and fourth edge 208 and 210 perpendicular thereto. The plate 202 may include a ledge 216 along the outside of the fourth edge 210 of the plate 202 over which at least one clamp assembly 160 may be secured as herein described to further mount the shaper attachment 200 between the first pair of clamping rails 152. The clamping bolts 166 extend upwardly from the T-slot 162 through at least two openings 212 opposite the clamp assemblies 160 substantially at the opposite corners of the plate 202 and are each secured by wing nuts 214 permitting fast and easy removal of the shaper attachment 200 from the pantograph 10. An upper surface 218 of the plate 202 may include a longitudinal groove 220 machined therein substantially parallel to and near the fourth edge 210, the purpose for which will be hereinafter described. Depending upon the purpose for which the shaper attachment 200 is being used, various accessories to the shaper attachment may be used on the upper surface 218 of the plate 202.

To true or create a straight edge on the workpiece using the shaper attachment 200, accessories such as a fixed gage plate 222 and a moveable gage plate 224 are removably mounted on the upper surface 218 of the plate 202 substantially near the third edge 208 thereof. The fixed and moveable gage plates 222 and 224 are substantially rectangular, each about half the length of the plate 202 and are oriented the same way as the shaper attachment plate 202. The fixed gage plate 222 includes a pair of spaced apart openings 226 to receive a first pair of mounting screws (not shown). The moveable gage plate 224 may include a first pair of spaced apart adjustment slots 230 for selective placement of a second pair of mounting screws (not shown). The upper surface 218 of the plate 202 includes threaded openings (not shown) for receiving the threaded portion of the first and second pair of mounting screws (not shown). The fixed and moveable gage plates 222 and 224 are removably mounted end to end with a reference notch 238 therebetween. The reference notch 238 may be machined into the upper surface 218 of the shaper attachment plate 202 in the space between the fixed and moveable gage plates 222 and 224 to serve as the tool clearance. When mounted, the first pair of adjustment slots 230 of the moveable gage plate 224 run substantially parallel to the clamping rails.

When truing or creating a straight edge on the workpiece, the moveable gage plate 224 is offset from the fixed gage plate 222 toward the workpiece. The tool 18 is positioned flush with the moveable gage plate 224 by turning the screw 194 on the moveable jaw assembly 186 that is mounted in the template area between the respective pair of clamping rails. The workpiece is advanced by hand into the tool 18 guided first by the fixed gage plate 222. As the tool 18 engages the workpiece, a substantially straight edge is created. The moveable gage plate 224 then becomes the guide for finishing the cut.

Figure 10:
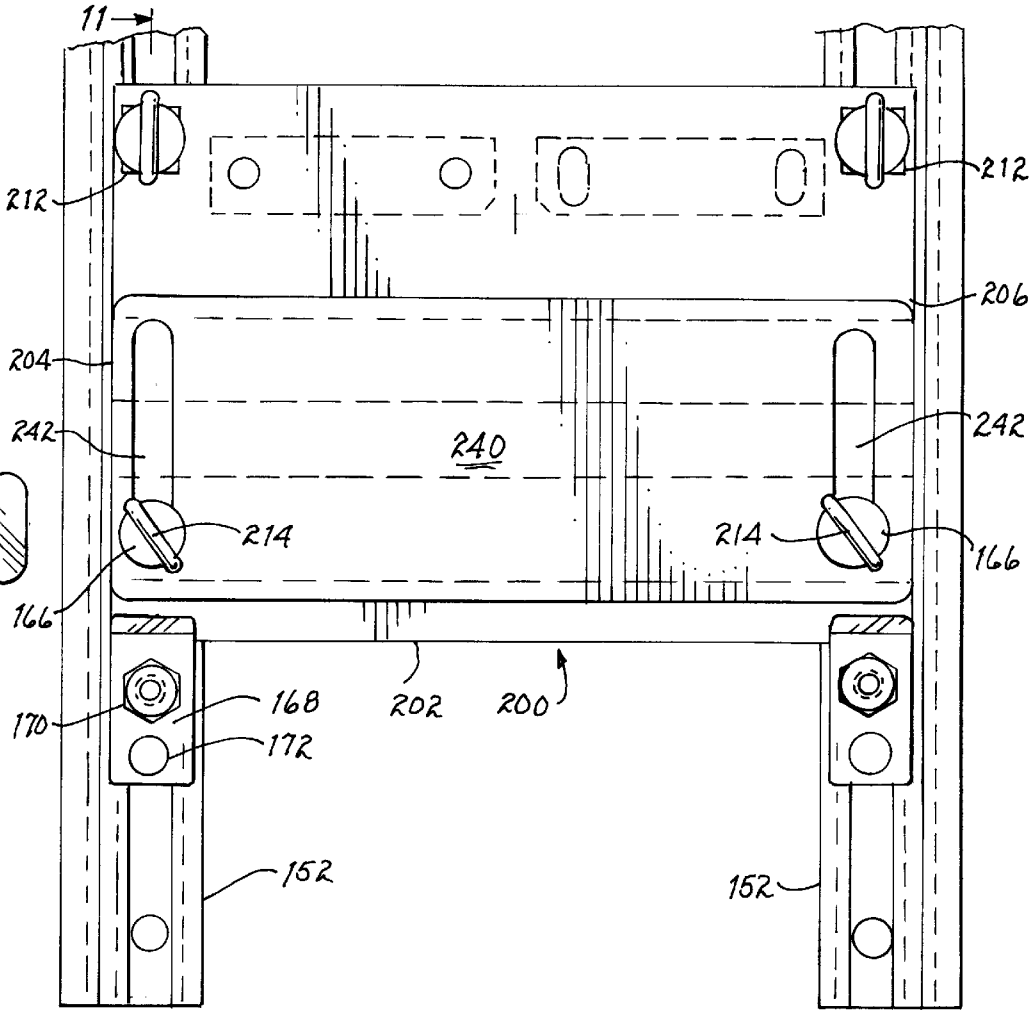
FIG. 10 is a top view of the mounted shaper attachment plate, illustrating a parallel gage plate mounted to the upper surface of the plate by a pair of clamping bolts, the threaded portion of the clamping bolts passing through two of the corner openings and received in a pair of adjustment slots defined in the parallel gage plate and secured by wingnuts, the fixed and moveable gage plates shown in phantom lines as they are removed when using the parallel gage plate.
Figure 11:
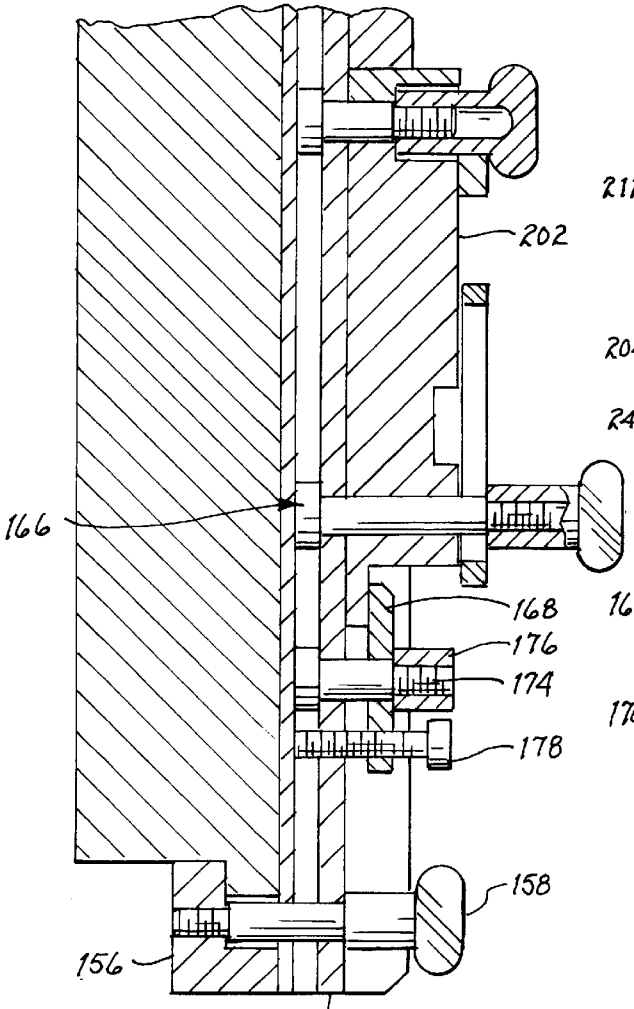
FIG. 11 is a sectional view taken generally along line 11—11 of FIG. 10, illustrating the mounting arrangement of the shaper attachment plate to one of the first pair of clamping rails and of the parallel gage plate to the upper surface of the shaper attachment plate.

To create parallel edges on the workpiece using the shaper attachment 200, the fixed and moveable gage plates 222 and 224 are removed and an accessory referred to as a parallel gage plate 240 is removably mounted on the upper surface 218 of the shaper attachment plate 202 as shown in FIG. 10. The parallel gage plate 240 is substantially rectangular with its ends secured by the clamping bolts 166 extending upwardly from the first pair of clamping rails 152. The parallel gage plate 240 includes a second pair of adjustment slots 242 running substantially parallel to the clamping rails. The second pair of adjustment slots 242 receives the threaded portion 174 of the clamping bolts 166, which are then secured by a wing nut 214. The parallel gage plate 240 may be moved with the clamping bolts 166 tightened anywhere along the length of the second pair of adjustment slots 242 so that, for example, the space between the inside edge of the parallel gage plate 240 and the tool position is increased or decreased to accommodate varying desired workpiece size.

To create parallel edges, one would first establish a straight edge as described above and the opposite edge may be cut parallel to it. The workpiece runs up flush against the inside edge of the parallel gage plate 240. The workpiece is then moved into the tool 18 guided by the parallel gage plate 240. The tool 18 may be advanced by degrees to achieve a precision and parallel dimension by turning the screw 194 on the moveable jaw assembly 186 of the vise which is clamped in the template area.

Figure 8:
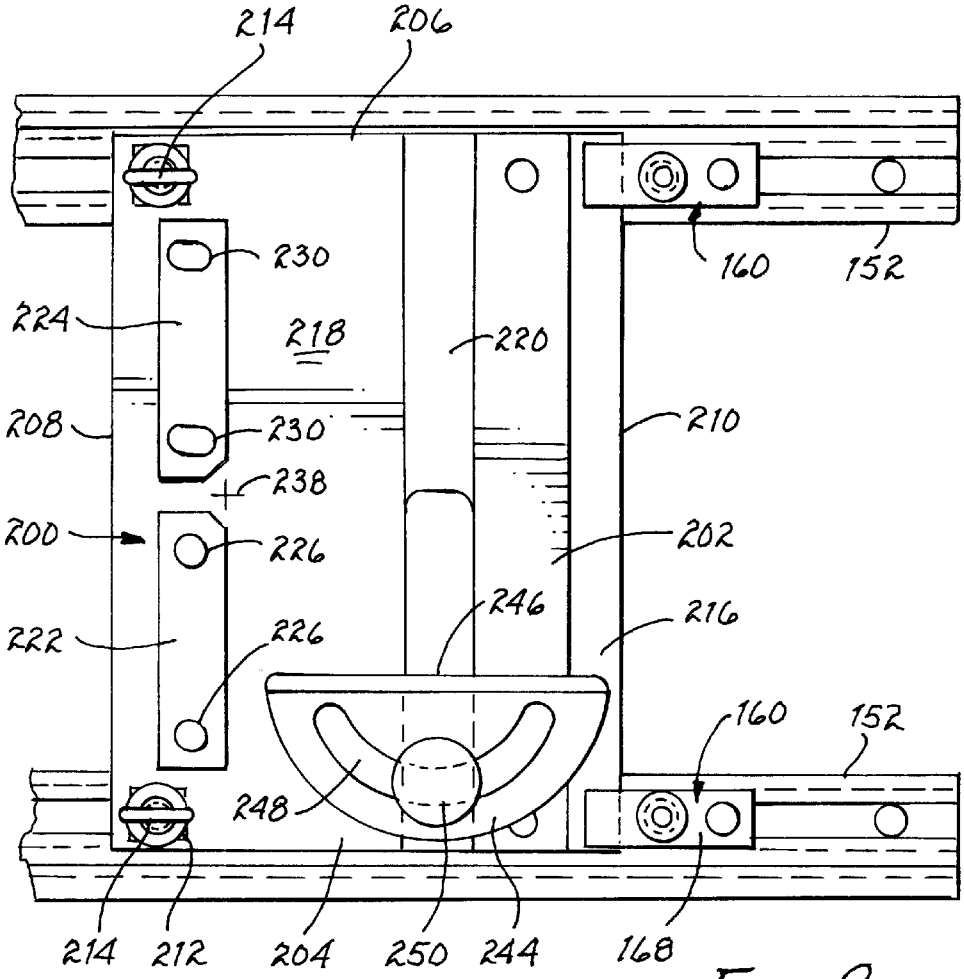
FIG. 8 is a top view of a shaper attachment mounted between and to the first pair of clamping rails, the shaper attachment including a plate having an opening at substantially each corner thereof and an upper surface on which a fixed gage plate and a moveable gage plate are removably mounted end to end with a reference notch in the space therebetween and having a longitudinal groove for moving therein an angle adjustment accessory and an outside ledge substantially parallel to the groove.
Figure 9:
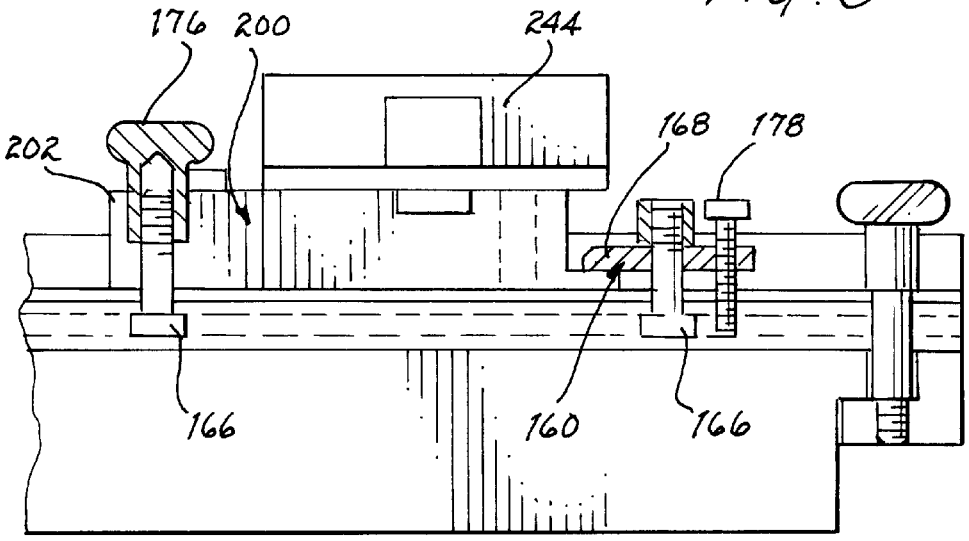
FIG. 9 is a sectional view of one of the first pair of clamping rails of FIG. 8, illustrating mounting of one edge of the shaper attachment plate thereto with a clamp assembly secured over the ledge by a clamping bolt and screw and another clamping bolt received in one of the corner openings, an opposite edge of the shaper attachment plate secured to the other of the first pair of clamping rails in the same manner.

To square adjacent workpiece edges or create angles thereon, an accessory referred to as an adjustable angle accessory 244 is used with the shaper attachment 200 as shown in FIG. 8. Such an attachment is often available with sanding belts and will be generally described. The accessory is generally in the shape of a semicircle with a straight edge thereof terminating in a straight edge 246. The semicircular portion includes a curved slot 248 for movement of an adjustable angle screw pin 250 therein, placement of which corresponds to markings on the outside of the semicircle referring to angles. The adjustable angle screw pin 250 may be tightened at the desired angle position.

To use the adjustable angle accessory 244, it is set to the desired angle and positioned freely in the groove 220. The parallel, fixed and moveable gage plates 240, 222 and 224 have been removed. The workpiece is held by finger pressure against the straight edge 246 of the adjustable angle accessory 244 as the accessory is manually slid down the groove 220, thus passing the tool 18. The tool 18 is advanced as required by turning the screw on the moveable jaw assembly 186.

To edge shape the workpiece, the moveable gage plate 224 is aligned with the fixed gage plate 222. A tool 18 with the desired angle, radius, or other shape is positioned as required. The workpiece is passed along the moveable and fixed gage plates 224 and 222 as the tool produces the bevel or other shape. The tool is advanced as required by turning the screw 194 on the moveable jaw assembly 186.

The pantograph 10 may be manufactured by injection molding of high-strength plastics. The use of metal for the clamping rails, and the precision and wear points may be considered. It is to be appreciated that other materials may be used for the pantograph although likely making the pantograph more costly, for example, aluminum. The edges may be rounded for increased safety. The simplicity of its construction permits it to be priced for the hobbyist's budget. The above design decreases cost, reproducibility of the copy and adapts to tools that hobbyists may already own. Furthermore, character sets are not required and the work area is substantially larger. Additionally, it adapts to various attachments and accessories including, but not limited to, the shaper attachment and the accessories described above.

In operation and in the method of the invention, the ratio between the input and the output are first selected and the pivot pins 42 in the arm assembly 14 moved accordingly as described above. The template, workpiece, stylus insert and tool are then selected. The template is mounted on the upper surface of the base by tape in the template portion of the base or between the second pair of clamping rails. The workpiece is mounted between the first pair of clamping rails with or without use of the vise. The clamp assembly is then secured over at least one corner of the template and if no vise is used, over at least one corner of the workpiece. A pressure sensitive dial indicator 252 (FIG. 1B) may be used to substantially confirm that the workpiece is substantially flat before beginning to copy a shape thereon. Such dial indicators are available, for example, from The L.S. Starrett Co., Athol, Mass. The dial indicator 252 typically includes a dial 254 and a shaft 256 extending downwardly therefrom. The dial indicator may be modified to include a substantially cylindrical adapter 258 through which the shaft extends. The adapter 258 permits fitting of the dial indicator 252 in the tool holder adapter clamp 104. The workpiece should be adjusted until the dial indicator gauge measures zero indicating the workpiece is substantially flat. Other leveling measures may, of course, be used. Leveling of the workpiece is particularly important to ensure uniform engraving depth.

After leveling the workpiece, the hobbyist readies the stylus by choosing and inserting the stylus insert 82. The stylus 16 is then placed in the split nut 62 that is then tightened. The tool 18 is then inserted into the tool holder adapter clamp and if motorized, plugged in. The hobbyist holds the stylus like he or she would hold a pencil and pulls it down to contact the template. The stylus is then driven around the shape on the template with a simultaneous copy being engraved, cut, or otherwise marked on the workpiece.

From the foregoing, it is to be appreciated that the hobbyist pantograph of the present invention is relatively lightweight and compact. It is simple to operate and easily transportable. It may be used by anyone; however, amateur smiths, model makers, jewelry fabricators, artists or other hobbyists should find it particularly useful.

Although a particular embodiment of the invention has been described in detail for purposes of illustration, various modifications may be made without departing from the spirit and scope of the invention. Accordingly, the invention is not to be limited, except as by the appended claims.

I claim:

1. A hobbyist pantograph comprising in combination:

a base; and an arm assembly pivotally connected to the base and rotatable about a vertical and horizontal axis of rotation for cooperative movement of a stylus and a tool received therein, the arm assembly including a main beam that remains substantially horizontal.

2. The hobbyist pantograph of claim 1, wherein the arm assembly comprises the main beam pivotally connected at a main beam first end to the base and at a main beam second end to a stylus beam, and between the main beam first and second ends to a tool holder beam, the tool holder beam and the stylus beam each pivotally connected at a first end to opposite ends of an outboard associate beam in substantially parallel relationship to the main beam to form substantially the shape of a parallelogram, the tool holder beam and the stylus beam terminating respectively outside the parallelogram at a second end in the tool and the stylus.

3. The hobbyist pantograph of claim 2, wherein an adapter sized for the tool fits into a tool holder adapter clamp at the second end of the tool holder beam for receiving the tool and the stylus is received in a split nut at the second end of the stylus beam, the stylus adapted to move substantially vertically therein.

4. The hobbyist pantograph of claim 2, wherein the tool holder beam includes at least one opening at the first end and at least one opening substantially in the middle thereof for respectively mating with one of at least one opening in the associate beam and with one of at least one opening in the main beam for receipt of a pivot pin in each of the mated openings, placement of the pivot pins determining the ratio of movement between the tool and the stylus.

5. The hobbyist pantograph of claim 1, wherein the main beam is pivotally connected to the base through a main boss, the main boss providing rotation of the arm assembly through a main boss pin and a main beam pin.

6. The hobbyist pantograph of claim 3, wherein the stylus includes a substantially cylindrical body having an internal diameter defined by a precision bore for receiving a spring-loaded plunger therein having a precision bore at a lower end thereof to receive a collet for receiving an insert, the substantially vertical movement of the stylus controlled by plunger movement.

7. The hobbyist pantograph of claim 1, wherein an upper surface of the base is divided into a workpiece portion and a template portion, the workpiece portion under the tool and the template portion under the stylus.

8. The hobbyist pantograph of claim 7, wherein the upper surface of the base is divided by a first pair of clamping rails in the workpiece portion of the base and a second pair of clamping rails in the template portion of the base, the ends of the first and second pair of clamping rails moveably secured around a clamping ledge at opposite edges of the base.

9. The hobbyist pantograph of claim 8, wherein a workpiece is removably mounted by mounting means between the first pair of clamping rails.

10. The hobbyist pantograph of claim 8, wherein a vise is removably mounted by mounting means between the first pair of clamping rails and a workpiece is positioned in the vise.

11. The hobbyist pantograph of claim 8, wherein a vise is removably mounted by mounting means between the second pair of clamping rails and includes an upstanding ball pin that is received in a lower end of the stylus and a shaper attachment is removably mounted by mounting means between the first pair of clamping rails for shaping at least one edge of a workpiece that is positioned to move along an upper surface of the shaper attachment.

12. The hobbyist pantograph of claim 8, wherein a template is removably mounted by mounting means between the second pair of clamping rails.

13. The hobbyist pantograph of claims 9, 10, 11, or 12, wherein the mounting means includes at least one clamping bolt, the at least one clamping bolt having a substantially square head received in a T-slot in each of the clamping rails and an upstanding threaded portion secured by a nut.

14. The hobbyist pantograph of claim 13, wherein the upstanding threaded portion of the clamping bolt is received in at least one opening in a clamping plate of a clamp assembly.

15. A hobbyist pantograph comprising in combination:

a base;

an arm assembly substantially in the shape of a parallelogram including a main beam pivotally linked to the base by a main boss pin and to a stylus beam and a tool holder beam, each of the stylus beam and tool holder beams pivotally linked at a first end to an associate beam in substantially parallel relationship to the main beam and outboard of the base, the main boss pin permitting rotation of the main beam about a vertical and horizontal axis of rotation with the main beam remaining substantially horizontal; and a stylus and a tool respectively received in a second end of the stylus beam and of the tool holder beam, wherein movement of the stylus over a shape on a template moves the tool to make a substantially precise scaled copy of the shape on a workpiece.

* * * * *